US005720224A

United States Patent [19]

Mueller

[11] Patent Number: 5,720,224

[45] Date of Patent: Feb. 24, 1998

[54] ARRANGEMENT FOR CONTROLLING FOLDING PROCESSES IN ROLLER ROTARY PRINTING MACHINES

[75] Inventor: Eckhard Mueller, Leipzig, Germany

[73] Assignee: Zirkon Druckmaschinen GmbH, Leipzig, Germany

[21] Appl. No.: 586,292

[22] Filed: Jan. 16, 1996

[30] Foreign Application Priority Data

Jan. 16, 1995 [DE] Germany ..... 195 00 929.0

[51] Int. Cl.[6] ..... B41F 13/24

[52] U.S. Cl. ..... 101/248; 270/49; 493/427; 493/405

[58] Field of Search ..... 101/226, 232, 101/227, 407.1, 248; 493/427, 428, 397, 399, 403, 405; 270/21.1, 43, 49

[56] References Cited

U.S. PATENT DOCUMENTS

| | | | |
|---|---|---|---|
| 3,699,886 | 10/1972 | Hewuel | 101/411 |
| 3,774,536 | 11/1973 | Raymond et al. | 101/365 |
| 4,892,036 | 1/1990 | Lange | 270/43 |
| 4,895,356 | 1/1990 | Rudolf | 270/49 |
| 5,048,387 | 9/1991 | Niitsuma et al. | 83/344 |
| 5,072,919 | 12/1991 | Schneider et al. | 270/49 |
| 5,096,174 | 3/1992 | Nishihara | 270/49 |
| 5,096,175 | 3/1992 | Lange et al. | 270/49 |
| 5,120,049 | 6/1992 | Fischer | 493/480 |
| 5,215,014 | 6/1993 | Burger et al. | 101/248 |
| 5,327,829 | 7/1994 | Miyoshi et al. | 101/248 |
| 5,522,586 | 6/1996 | Bennett et al. | 270/21.1 |
| 5,527,256 | 6/1996 | Vauchellie | 493/424 |

*Primary Examiner*—Eugene H. Eickholt
*Attorney, Agent, or Firm*—Michael J. Striker

[57] ABSTRACT

An arrangement for controlling folding processes in roller rotary printing machines comprises a must for producing a fold, a cutter cylinder, and a displacing device which axially displaces the cutting cylinder before and/or during a folding process by a magnitude of a pre-folding.

6 Claims, 1 Drawing Sheet

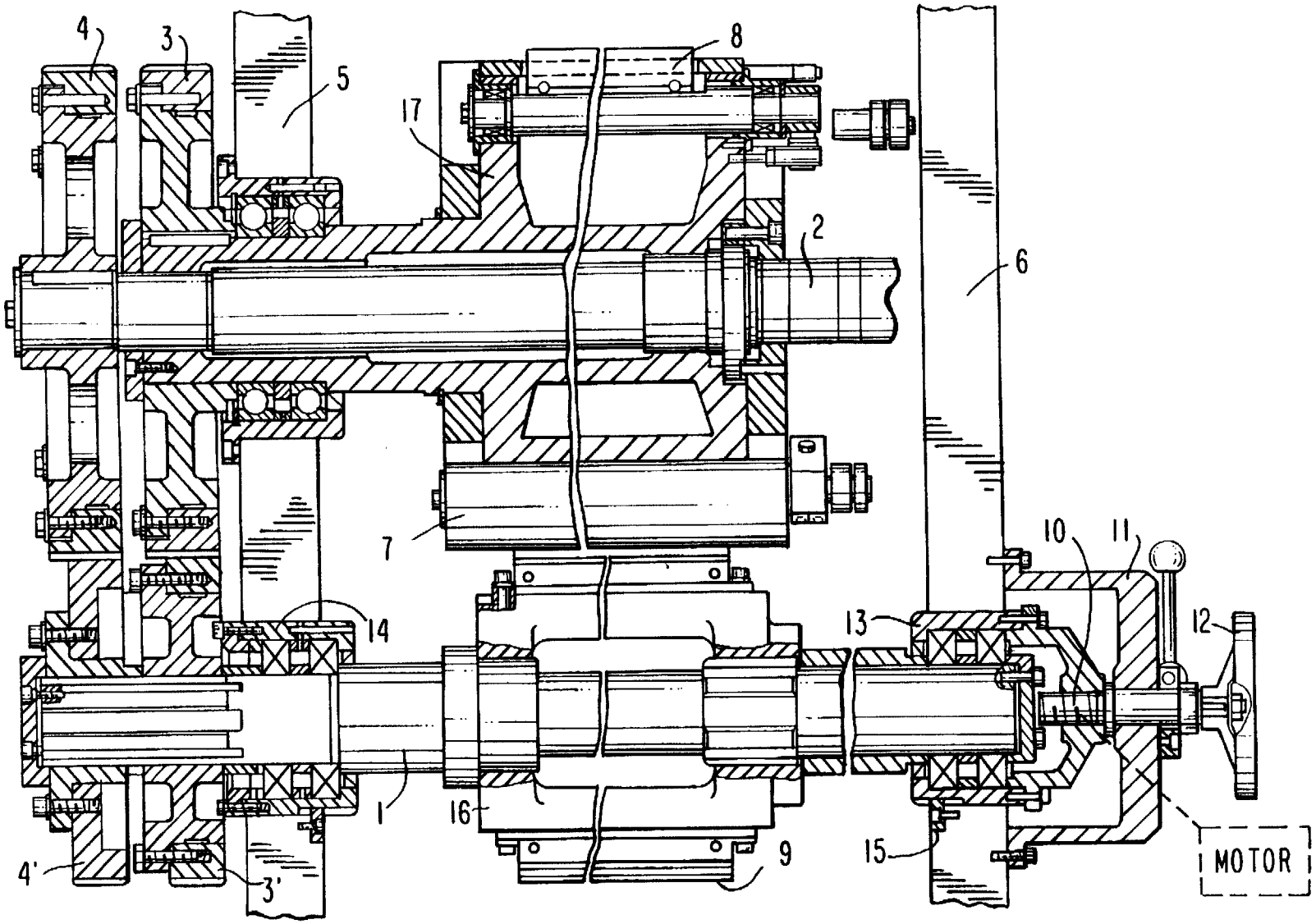
MOTOR
1
2
3
3'
4
4'
5
6
7
8
9
10
11
12
13
14
15
16
17

ARRANGEMENT FOR CONTROLLING FOLDING PROCESSES IN ROLLER ROTARY PRINTING MACHINES

BACKGROUND OF THE INVENTION

The present invention relates to an arrangement for controlling of folding processes in roll rotary printing machines with a device with producing folds.

Arrangements of the above mentioned general type are known int he art. The German document DE-OS 4136792 discloses a device for automatic production of folds in a folding apparatus of rotary printing machines. In this device an adjusting unit is arranged inside the fold-product guiding cylinder. The adjusting device is actuated by a remotely controlled drive. The change of the working positions of folding members and transporting members on the periphery of fold product guiding cylinder relative to one another is performed by the adjusting device. Because of the integration of the adjusting device in the fold product guiding cylinder, mounting space is saved in the region of the side walls, while the hollow space in the fold product guiding cylinder is utilized. Additional toothed gears which are used during the adjustment in the side walls can be dispensed with. Therefore movable masses are reduced and a double side wall for receiving the additional toothed gears is not needed.

The above mentioned arrangement however has the disadvantage that high expense is needed during the adjustment of the pre-folding. In addition, various adjustments are also required during the production with pre-folding and without pre-folding.

SUMMARY OF THE INVENTION

Accordingly, it is an object of the present invention to provide an arrangement for controlling folding processes in roller rotary printing machines, which avoids the disadvantages of the prior art.

In keeping with these objects and with others which will become apparent hereinafter, one feature of the present invention resides, briefly stated, in an arrangement for controlling folding processes in roller rotary printing machines with a device for producing folds, wherein in accordance with the present invention the cutting cylinder is associated with a displacing device which displaces the cutting cylinder by a magnitude of a pre-folding before and/or during the folding process.

When the arrangement is designed in accordance with the present invention, it controls the folding processes which can be performed with low expense both during stoppage as well as also during the machine running, and the distance between the needle punctures and the cutting edges both during the production with pre-folding and also during the production without pre-folding always remains the same.

In accordance with another feature of the present invention, the displacing device for axial displacement of the cutting cylinder includes a threaded spindle which is in a working connection with the axle of the cutting cylinder.

Still another feature of the present invention is that the axis of the fold cutter cylinder is in operative connection with the axis of the cutting cylinder through an inclined-toothed gear pair and a straight-toothed gear pair extending parallel to it.

Still a further feature of the present invention is that the threaded spindle is associated with the remotely controlled motor which performs the controlling of the axial displacement.

Finally, the fold cutter cylinder can be formed as a subdivided cylinder, and the puncture needles and the folding cutter can be arranged on it turnably relative to one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing an arrangement for controlling folding processes in roller rotary printing machines.

DESCRIPTION OF PREFERRED EMBODIMENTS

A roller rotary printing machine has walls 5 and 6, a cutting cylinder 16 with an axle 1, and bearing bushing 13 and 14, and a fold cutter cylinder 17 with an axle 2 connected with a drive. A toothed gear pair with inclined teeth is identified with reference numeral 3, 3' and the toothed gear pair with straight teeth is identified with reference numeral 4, 4'. An arrangement for controlling folding processes includes a threaded spindle which is identified with reference numeral 10 and arranged in a bearing block 11. The threaded spindle 10 axially displaces the cutting cylinder 16 and thereby a bearing bushing 1 as well as the toothed gear 4' with straight teeth and the toothed gear 3'with inclined teeth, in correspondence with the magnitude of the pre-folding. Since the toothed gear 3' with inclined teeth engages with the corresponding toothed gear 3 of the folding apparatus, the toothed gear 3' and thereby cutting cylinder 16 is turned by a predetermined magnitude during the axial displacement. The toothed gear 4' with straight teeth is in engagement with the toothed gear 4 with straight teeth, and therefore the toothed gear 4' as well as the axle 1 of the cutting cylinder 13 is turned. As a result, the product is cut relative to the fold cutter cylinder 17 earlier, and the length between the folding line (2.fold) and the cutting edge is shorter, which performs pre-folding.

In order to guarantee that the punctures of the puncture needles 7 both during the adjusted pre-folding and also during the production without pre-folding have only the same distance from the cutting edge of the product, the puncture needles 7 must turn on the fold cutter cylinder 17 during the turning of the cutting cylinder 16 by the same magnitude and in the same direction as the cutter 9 on the cutting cylinder 16. The position of the folding cutter 8 on the fold cutter cylinder 17 must however not be changed.

For these reasons the fold cutter cylinder 17 is formed as a subdivided cylinder, and an additional toothed gear 4' with straight teeth is arranged on the cutting cylinder 16. In other words the puncture needles 7 and the folding cutter 8 are arranged on the fold cutter cylinder 17 turnably relative to one another and their drives are provided separately from one another from the cutting cylinder 16 through an associated toothed gear. The toothed gear pair 3, 3' with inclined teeth drives the fold cutter 8, and the toothed gear pair 4, 4' with the straight teeth drives the puncture needles 7 on the subdivided fold cutter cylinder 17.

When the cutting cylinder 16 is moved axially, it is not rotated in correspondence with the adjusted value of the prefolding. This rotation is transmitted to the part of the fold cutter cylinder 17 through the toothed gear pair 4 with the straight teet, which fold cutter cylinder 17 holds the puncture needles 7. The puncture needles 7 follow thereby the cutter 9 on the cutting cylinder 16 in its rotary movement, and therefore the punctures of the puncture needles 7 have only the smae distance to the cutting edge of the product.

In the shown example the axial displacement of the cutting cylinder 16 is performed by the threaded spindle 10 through a hand wheel 12. An automatization is possible when the hand wheel 12 is replaced for example by an electric drive (transmission motor).

It will be understood that each of the elements described above, or two or more together, may also find a useful application in other types of constructions differing from the types described above.

While the invention has been illustrated and described as embodied in an arrangement for controlling folding processes in roller rotary printing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific apsects of this invention.

What is claimed as new and desired to be protected by Letters Patent is set forth in the appended claims:

1. An arrangement for controlling folding processes in roller rotary printing machines, comprising means for producing a fold; a cutting cylinder; and a displacing device which axially displaces said cutting cylinder before and/or during a folding process by a magnitude of a pre-folding.

2. An arrangement as defined in claim 1, wherein said device for axially displacing said cutting cylinder has a threaded spindle, said cutting cylinder having an axle, said threaded spindle being in operative connection with said axle of said cutting cylinder.

3. An arrangement as defined in claim 1; and further comprising a fold cutter cylinder having an axle, said cutting cylinder having an axle which is connected with said axle of said fold cutter cylinder; and means for connecting said axle of said cutting cylinder with said axle of said fold cutter cylinder.

4. An arrangement as defined in claim 1, wherein said means for connecting include a toothed gear pair with inclined teeth and a toothed gear pair with straight teeth extending parallel to said toothed gear pair with inclined teeth.

5. An arrangement as defined in claim 1, wherein said device for axially displacing said cutting cylinder includes a threaded spindle; and further comprising means for controlling said axial displacement and including a movably controlled motor associated with said threaded spindle.

6. An arrangement as defined in claim 1; and further comprising a fold cutter cylinder formed as a subdivided cylinder; puncture needles; and a fold cutter, said puncture needle and said fold cutter being arranged on said fold cutter cylinder rotatably relative to one another.

* * * * *